United States Patent [19]

Fowlkes et al.

[11] Patent Number: 4,949,129

[45] Date of Patent: Aug. 14, 1990

[54] APPARATUS FOR TRANSFERRING TONER IMAGES TO A RECEIVING SHEET

[75] Inventors: William Y. Fowlkes, Brockport; Bruce J. Rubin; Victor C. Solomon, both of Rochester; William B. Vreeland, Webster, all of N.Y.

[73] Assignee: Eastman Kodak Company, Rochester, N.Y.

[21] Appl. No.: 375,105

[22] Filed: Jul. 3, 1989

[51] Int. Cl.[5] ..... G03G 15/16

[52] U.S. Cl. ..... 355/274; 355/73; 355/271; 355/312; 355/326

[58] Field of Search ..... 355/274, 273, 275, 271, 355/312, 326, 327, 73; 361/234

[56] References Cited

U.S. PATENT DOCUMENTS 3,776,630 12/1973 Ohno et al. ..... 355/271 X
3,869,203 3/1975 Lehmann ..... 355/327
3,993,021 12/1976 Kline ..... 355/275 X
4,272,181 6/1981 Treseder ..... 355/312 X
4,739,361 4/1988 Roy et al. ..... 355/73 X
4,862,224 8/1989 Ku ..... 355/271 X

*Primary Examiner*—Fred L. Braun
*Assistant Examiner*—Sandra L. Hoffman
*Attorney, Agent, or Firm*—Leonard W. Treash

[57] ABSTRACT

A transfer member, for example, a transfer drum utilizes a vacuum applied through vacuum holes to the drum surface for holding a receiving sheet. A toner image is transferred to the sheet under the urging of an electric field. To prevent non-transfer over the vacuum holes, the holes are filled or covered with a conductive material that is sufficiently conductive to maintain the electric field over the holes and sufficiently porous to maintain the vacuum at the surface. For example, a polyurethane foam material can be used for the material in or over the vacuum holes.

18 Claims, 3 Drawing Sheets

APPARATUS FOR TRANSFERRING TONER IMAGES TO A RECEIVING SHEET

RELATED APPLICATIONS

This application is related to co-assigned:

U.S. patent application Ser. No. 375,240, filed Jul. 3, 1989, TRANSFER APPARATUS HAVING A TRANSFER MEMBER WITH VACUUM MEANS, Marcus S. Bermel et al.

U.S. patent application Ser. No. 375,165, filed Jul. 3, 1989, TRANSFER APPARATUS HAVING VACUUM HOLES FOR HOLDING AND RECEIVING SHEET, Richard C. Baughman et al.

U.S. patent application Ser. No. 375,110, filed Jul. 3, 1989, TRANSFER APPARATUS HAVING VACUUM HOLES AND METHOD OF MAKING SUCH APPARATUS, Richard C. Baughman et al.

TECHNICAL FIELD

This invention relates to apparatus for transferring electrostatically held toner images to a receiving sheet. More specifically, this invention relates to such apparatus including a transfer roller or drum having vacuum holes or the like for holding the receiving sheet as it passes through transfer relation with a toner image.

BACKGROUND OF THE INVENTION

U.S. Pat. No. 4,712,906, Bothner et al, shows an electrophotographic color printer which forms consecutive images in different colors that are transferred in registry to a receiving sheet. The receiving sheet is wrapped on a transfer drum or roller and recirculated on the surface of the drum into transfer relation with the consecutive images to create a multicolor image on the sheets. To improve efficiency, large sheets, for example, "ledger" size sheets are placed on the drum with the small dimension parallel to the axis of the drum and wrapped substantially around the transfer drum. Small sheets, for example, "letter" size sheets are placed with their long dimension parallel to the axis of the drum. Since the short dimension of letter size sheets is approximately half the long dimension of ledger size sheets, two letter size sheets are placed on the drum in approximately the same space as the single ledger size sheet.

Prior to the Bothner invention, commercial color image transfer devices secured the receiving sheet to the transfer drum with small gripping fingers that grip the leading edge of the sheet. Many other methods are mentioned in the literature, for example, vacuum holes, electrostatics or combinations of vacuum holes, electrostatics and gripping fingers. The gripping fingers were preferred commercially because they more firmly hold the sheet against slippage, which slippage would degrade the registration of the images.

However, the Bothner invention is difficult to utilize with gripping fingers because the leading edge of the second letter size sheet is positioned at approximately the middle of a ledger size sheet. For some applications, retractable fingers may be made to work, but for many applications they would leave substantial image artifacts in a ledge size sheet. Bothner therefore suggests the use of vacuum holes which are positioned at the leading edge of each of the smaller sheets and may or may not both be activated for the ledger size sheet.

To firmly hold fairly heavy stock the holes were made as large as 3–6 mm in diameter and placed less than one to a centimeter in a line across the drum.

The vacuum holes shown in Bothner work fine in many situations. However, under some conditions, the vacuum holes show up on the final image as small round areas of incomplete toner transfer. This is especially true in dry ambient conditions, with transparency receiving stock, and with the second transfer to duplex receiving sheets where the receiving sheet has been dried by a prior fusing step.

Even in dry conditions, the artifacts may be acceptable if they were confined to the leading edge of all sheets where image information is unlikely. However, the Bothner apparatus forces at least one line of vacuum holes for the leading edge of the second small sheet, to the middle of a large sheet. Further, in different sheet holding applications, it may be necessary to put vacuum holes at the trailing edge as well as the leading edge of at least some sheets. If a variety of sheet sizes is to be available, many lines of trailing edge holes will be necessary. Vacuum holes on the trailing edges of a variety of sheets place many lines of holes in the middle of larger sheets, depending on the mixture of sizes available in the machine.

U.S. Pat. No. 4,080,053, Friday, shows a vacuum web transport for a copy sheet through a transfer station having a rather lengthly transfer area formed by parallel portions of the transfer web and a photoconductive web. To prevent what the reference termed "vacuum hole printout", the effective position of the holes is gradually moved to different locations during passage through the transfer zone. Whatever the effectiveness of this solution for the apparatus shown, it would not be useful with the relatively small transfer zone formed by a transfer drum with either an image carrying web or drum.

The Bothner apparatus shows a transfer drum having an aluminum base with a polyurethane coating of intermediate conductivity. The layer of intermediate conductivity allows the creation of a relatively strong transfer electric field without electrical breakdown in the nip. It is believed that the failure to transfer toner over a vacuum hole is due to lack of continuity of the electric field in that region when a less conductive, for example, a dryed out transfer sheet is being used.

DISCLOSURE OF THE INVENTION

It is the object of the invention to provide an apparatus for transferring electrostatically held toner images to a receiving sheet, which receiving sheet is held by a vacuum to a transfer member, but with a reduction of the aforementioned image defect associated with vacuum holes.

This and other objects are accomplished by a conductive means positioned in said vacuum holes which means permits the application of the vacuum through the holes.

According to a preferred embodiment the apparatus includes a transfer drum having a conductive surface to which an electrical bias is applied to create an electrical field urging a toner image toward the drum. The drum has vacuum holes to the surface to hold a receiving sheet on the surface of the drum. Means is positioned in each vacuum hole that is sufficiently conductive to improve the continuity of electric field despite the vacuum hole and sufficiently porous to permit maintenance of a vacuum on the receiving sheet.

According to a further preferred embodiment the conductive means is a conductive foam material.

BRIEF DESCRIPTION OF THE DRAWINGS

In the detailed description of the preferred embodiment of the invention presented below reference is made to the accompanying drawings, in which.

BEST MODE OF CARRYING OUT THE INVENTION

Figure 1:
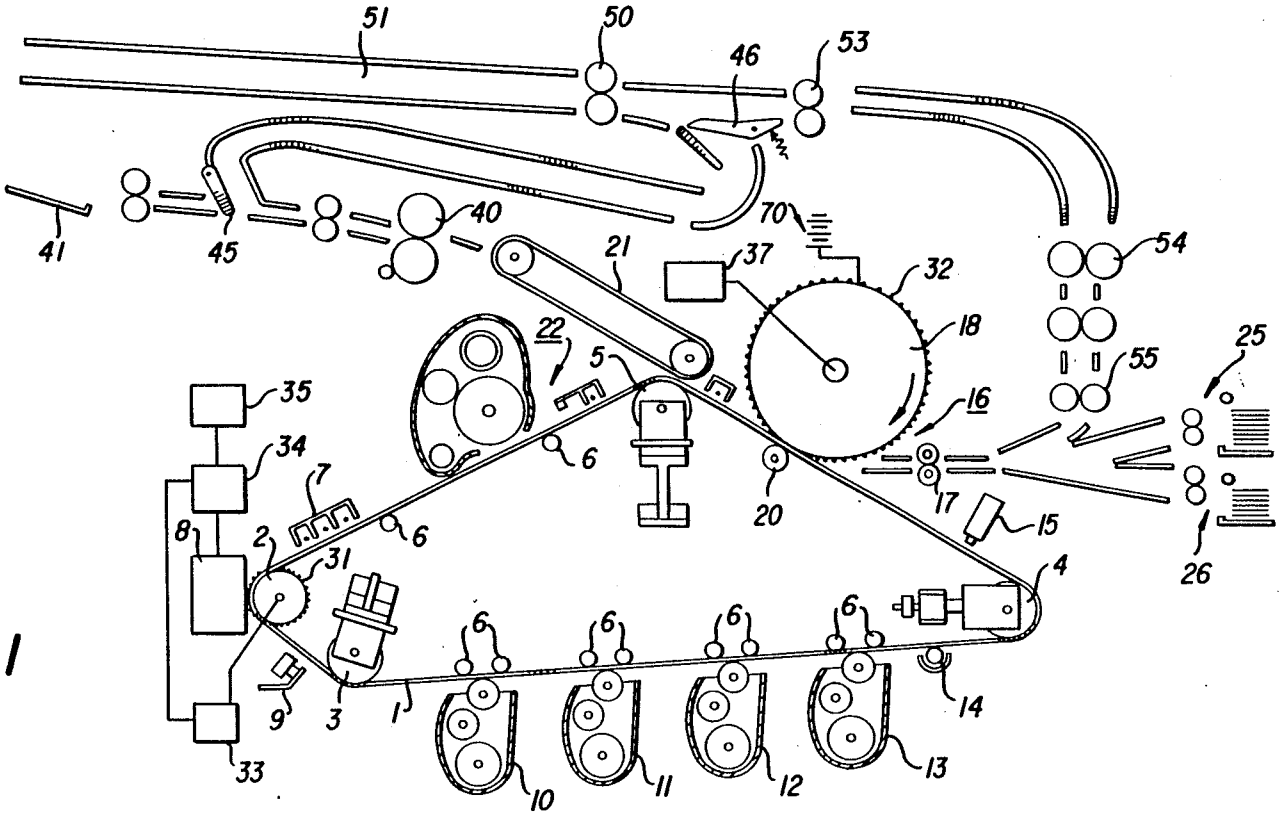
FIG. 1 is a schematic side view of a printer constructed according to the invention, with many parts eliminated for clarity of illustration.

According to FIG. 1 a film core portion of a copier or printer includes an image bearing member, for example, an endless electrophotoconductive web 1 entrained about a series of primary rollers 2, 3, 4 and 5, and other supporting structure, for example, film skis 6.

Web 1 is driven through a series of electrophotographic stations generally well-known in the art. More specifically, a uniform charge is laid down on the web 1 by a charging station 7. The uniformly charged web moves around printhead roller 2 which is directly opposite an LED printhead 8 which LED printhead exposes the web 1 in a manner well-known in the art. The web then moves into operative relation with an electrometer 9 which senses the level of a charge existing after exposure of the web by printhead 8, to help control the process.

The web then moves into operative relation with a series of toning or developing stations 10, 11, 12 and 13. Each image created by printhead 8 is toned by one of the toning stations. After being toned the web passes a magnetic scavenger 14 which removes excess iron particles picked up in the toning process. After the elastrostatic image has been toned the web passes under a densitometer 15 which measures the density of the toner image also for use in controlling the process. The toner image then proceeds to a transfer station 16 where the image is transferred to a transfer surface of a receiving sheet carried by a transfer drum 18.

The transfer drum 18 includes vacuum holes 19 (FIGS. 2-5) for securing the copy sheet thereto for repeated presentations to web 1. The transfer drum 18 cooperates with web 1 to incrementally bring the receiving sheet and the toner image into transfer relation so that the toner image is transferred to the copy sheet. As is well known in the art, this is generally accomplished in the presence of an electric field which is created by biasing the transfer drum by a suitable biasing means, for example, electrical source 70, compared to the conductive layer of the web 1 or to a backing roller 20 for the web. This process has been well-known in the art for many years, see for example, U.S. Pat. No. 3,702,482. Although either the web 1 or the drum 18 could be at ground, conventionally the conductive backing is at ground and the drum at a relatively high voltage. For example, if the toner to be transferred is positively charged, the drum can be biased to −3000 V by electrical source 70.

As thoroughly discussed in U.S. Pat. No. 4,712,906, cited above, when the apparatus is operating in a multi-image mode, for example, a multicolor mode, consecutive images or pairs of images are toned with different colored toners using the different toning stations 10-13. These consecutive images are transferred in registry to the receiving sheet as it repeatedly is brought into transfer relation with the web 1 by the drum 18. After the transfer operation is complete, the receiving sheet is allowed to follow the web, for example, by removing the vacuum holding it to the drum 18 or by stripping the sheet with a skive, other conventional stripping mechanism, or both. The receiving sheet is separated from the web with the aid of an electrostatic sheet transport mechanism 21 and is transported to a fuser 40. The web is then cleaned by the application of a neutralizing corona and a neutralizing erase lamp and a magnetic brush cleaning mechanism all located at a cleaning station 22.

Figure 2:
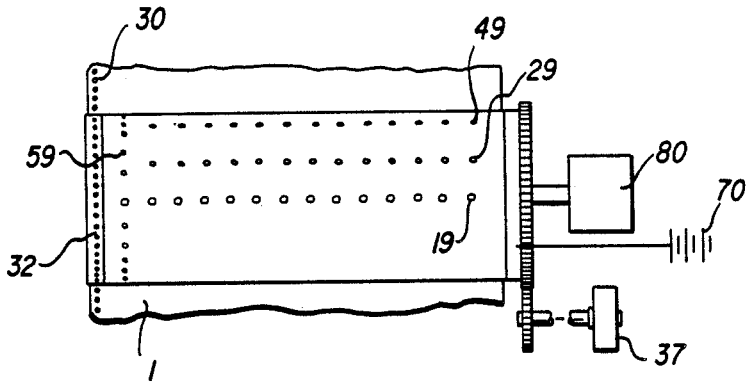
FIG. 2 is a top view of a portion of a transfer apparatus in which the invention is usable.

The transfer drum 18 is driven by a motor 37, the drum 18 in turn driving the web 1 through a sprocket 32 which engages perforations 30 (FIG. 2). The sprocket 32 also forms part of a registration and timing system which includes a sprocket 31 on printhead roller 2 which sprocket is linked to an encoder 33. The encoder 33 feeds signals indicative of the angular position of sprocket 31 to a drive 34 for the printhead 8 which drive 34 times the application of information from an information source 35 to the printhead 8.

After the receiving sheet leaves the fuser 40 it can go directly to an output tray 41 or be deflected by a deflector 45 into a duplex path according to the position of deflector 45, the position of which is controlled by the logic of the apparatus through means not shown. The duplex path moves the sheet by rollers and guides directing it first through a passive deflector 46 into turn-around rollers 50. Turn-around rollers 50 are independently driven to drive the receiving sheet into turn-around guide means 51, until the trailing edge thereof has been sensed by an appropriate sensor, not shown, to have passed passive diverter 46. Once the trailing edge has passed passive diverter 46 the turn-around rollers 50 are reversed and the receiving sheet is driven by rollers 50 and other sets of drive rollers 52, 53, and 54 back to a position upstream of the transfer station 16. The receiving sheet can pass through registration mechanisms for correcting for skew, crosstrack misalignment and in-track misalignment and ultimately stop at alignment rollers 55.

Transfer station 16 receives sheets from any of three sources. First, it can receive sheets of one particular size from a first supply 25, which first supply may include, for example, letter size sheet being fed with their short dimension parallel with the direction of feed. Second, it may receive sheets from a second supply 26, which, for example, may include ledger size sheets with their long dimension parallel to the direction of movement. Third, the transfer station 16 may receive sheets from the duplex path as controlled by rollers 55 which may include either size sheet and would already contain a fused image on its upper side. The receiving sheets from whatever source, stop against timing rollers 17. In response to a signal from the logic and control of the apparatus, not shown, timing rollers 17 accelerate to drive the receiving sheet into the nip between the transfer drum 18 and the web 1 as the first toner image to be transferred approaches the nip.

The duplex path is of a length that takes multiple sheets at one time depending on the length of the sheets.

For example, four letter size sheets may be in the duplex path at one time or two ledger size sheets. If the printer is printing different images on different sheets, the logic and control of the apparatus must supply the necessary programming to the exposure and toning stations so that the sheets ultimately fed to the output tray 41 are in the correct order considering the number of sheets that must be in the duplex path. Such programming is known in the art, see, for example, U.S. Pat. No. 4,453,841.

Figure 3:
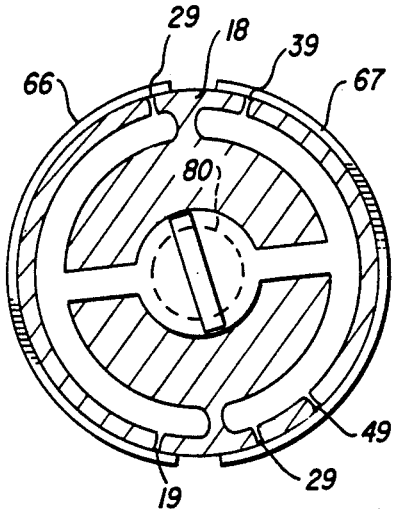
FIG. 3 is a side cross-section of a transfer drum shown in FIG. 2.

Transfer drum 18 is best seen in FIGS. 2 and 3. According to FIG. 2, vacuum holes 19 are positioned across the length of drum 18 to grip the leading edge of a receiving sheet. Vacuum is applied to the holes from a source of vacuum 80 through suitable conduits and valves, some of which are not shown. U.S. Pat. No. 4,712,906 is incorporated by reference herein and shows more details of a suitable mechanism for applying and releasing the vacuum at the appropriate times for the holes gripping the leading edges of receiving sheets.

The drum 18 has an aluminum core and a polyurethane outer layer. Preferably, the polyurethane is of an intermediate conductivity, for example, $5\times10^9$ ohms/cm. Transfer rolls having intermediate conductivity are well known and have certain advantages. See, for example, U.S. Pat. No. 3,781,105, Meagher, issued Dec. 25, 1973.

As seen in FIG. 3, vacuum holes 19 grip the leading edge of a first letter sized receiving sheet 66 which encompasses slightly less than half the circumference of the drum 18. The leading edge of a second letter size sheet 67 is gripped by another row of vacuum holes 39. For many grades of paper, vacuum holes for the leading edge are adequate. However, for best holding of a wide grade of materials, including transparency stock, vacuum holes 29 located along the trailing edge of the sheets assist in the holding process, preventing creep of the receiving sheet on the drum surface and thereby preventing misregistration of images. Additionally, a set of vacuum holes 59 can be positioned along one or both lateral edges of the image areas to provide additional holding force.

If a ledger sized receiving sheet is to be used, the leading edge is still attached using vacuum holes 19 but, the sheet will stretch across one row of holes 29 and the row of holes 39 ending up short of the second row of holes 29. To secure the trailing edge of ledger sheets an additional row of holes 49 is provided. If the trailing edge of all possible sizes of sheets (for example, legal size) is to be secured, additional rows of holes will be necessary.

Thus, even without the holes securing the trailing edges, at least one row of vacuum holes will lie underneath the primary image area during the transfer process of a ledger size sheet. With the additional rows of holes to secure the trailing edge of sheets, the number of holes is multiplied.

Under some conditions, the vacuum holes do not have an adverse effect on the final image. However, for many conditions, especially with a dry receiving sheet, for example, a sheet that has been through a fuser once and is now receiving the second side of a duplex copy or resin sheet as is used to make a transparency, insufficient transfer is present in the portion of the sheet overlying the vacuum holes. This shows up on a white receiving sheet as a white spot in the image. This phenomena is believed to be due to the fact that the transfer is accomplished primarily by a relatively strong electric field between the surface of the drum 18 and a conductive backing for the web 1. In a humid environment, the paper is more conductive and provides some continuity of the field over the holes. In dry conditions, the receiving sheet is less conductive and that field loses continuity over the holes. The toner does not transfer, staying on the surface of web 1.

Figure 4:
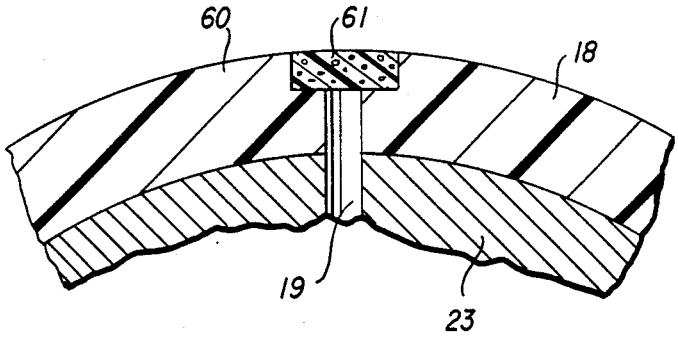
FIGS. 4 and 5 are side sections through one of the vacuum holes in the transfer drum shown in FIGS. 2 and 3 illustrating alternative embodiments to the invention.
Figure 5:
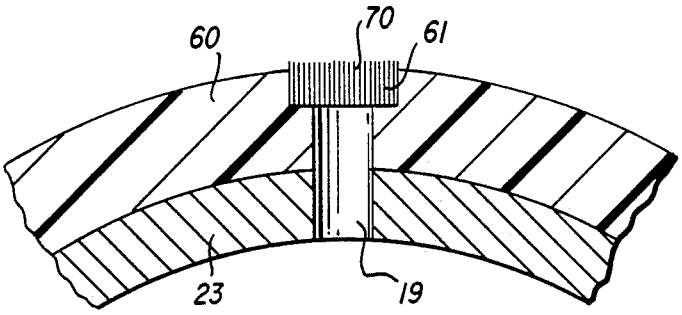

According to FIGS. 4 and 5, this problem is solved by positioning a conductive material in the vacuum holes which material is designed to permit the maintenance of the vacuum through the hole. Because the material is conductive, it provides electrical continuity in the hole area and helps maintain the continuity of the electric field that causes transfer.

According to FIG. 4, the surface of drum 18 is defined by a layer 60 of polyurethane into which vacuum hole 19 has been drilled. Typically, the resistivity of this polyurethane is $5\times10^9$ ohm-cm. and the layer is 4 mm thick. Layer 60 is bonded to an aluminum core 23. The vacuum hole 19 has a shallow large diameter bore 61 at the surface of the drum 18. The shallow bore 61 can, for example, be 5 mm in diameter and 2 mm deep. It is filled with a material porous enough to permit maintenance of a vacuum at the drum surface. For example, it may be filled with an open cell polyurethane foam or a reticulated foam. The polyurethane foam is made conductive by the addition of a conductive agent such as carbon or other similar material. It can be made to match the conductivity of the polyurethane layer 60 surrounding it, for example, by using the same conductive additives. With foam samples having cell diameters averaging 0.5 mm inches the vacuum can be maintained and the conductivity of the foam completes the continuity of the electrical field and causes transfer of toner in the hole areas.

According to FIG. 5, the large diameter bore 61 of the hole 19 is filled with a conductive fur or brush 70 which is adhered to the sides of the hole with a suitable conductive adhesive. It can extend somewhat outsidethe hole and, in practice, mats down to present a uniform surface to the receiving sheet. Suitable conductive furs are stainless steel and carbon fiber furs that can be made to a conductivity generally matching layer 60.

Although best results were obtained with a 2-diameter bore as shown in FIG. 4 a single diameter bore will also work. The advantage of the multi-diameter bore is to spread the effect of the vacuum in the area in which it is somewhat restricted by the foam.

The preferred approach for inserting the foam in the vacuum hole 19 is by shaping a plug of already formed foam and inserting it with a conductive adhesive. However, the foam can in fact be grown in the hole by methods well-known in the art in manufacturing such foams. In either case, for best results, it is preferable to regrind the surface after insertion or growing of the foam to assure regularity of the surface of the drum.

Another, less precise approach that has also proven effective, is to include more than one hole under the foam. For example, a recess across a portion of or the entire row of holes is filled with a foam insert on top of the holes.

The invention is particularly useful in the structure described above where vacuum holes may be required in the middle of image elements. However, it can be used effectively where only vacuum holes on the leading edges of documents are used since the leading edges may on occasion contain some image portions.

The invention has been described in detail with particular reference to a preferred embodiment thereof, but it will be understood that variations and modifications can be effected within the spirit and scope of the invention as described hereinabove and as defined in the appended claims.

We claim:

1. Apparatus for transferring a toner image from an image bearing member to a receiving sheet, which apparatus includes:

a transfer drum having a conductive surface and having vacuum holes to said surface, means for applying a vacuum to said vacuum holes to hold a receiving sheet on the surface of the drum, means for creating an electric field urging a toner image toward said drum, and means positioned in said vacuum holes, said means being sufficiently conductive to improve the continuity of said electrical field and sufficiently porous to permit maintenance of a vacuum on the receiving sheet.

2. Apparatus according to claim 1 wherein said conductive means is a solid open-celled foam material.

3. Apparatus according to claim 2 wherein said foam material is in the form of an insert positioned in said holes after said foam is formed.

4. Apparatus according to claim 2 wherein said material is grown as a foam in said holes.

5. Apparatus according to claim 1 wherein said conductive surface is the outside surface of a layer of polyurethane, and said conductive means is an open-celled polyurethane foam.

6. Apparatus according to claim 1 wherein the conductive means is a conductive fur or brush.

7. Apparatus for transferring an electrostatically held toner image to a receiving sheet, which apparatus includes a transfer member to which the receiving sheet is held by a vacuum applied through vacuum holes, characterized by conductive means positioned in said holes which conductive means permits the application of a vacuum through the vacuum holes.

8. Apparatus for transferring an electrostatically held toner image to a receiving sheet which apparatus includes a transfer drum having a conductive outer layer to which the receiving sheet is held by a vacuum applied through vacuum holes in said layer, characterized in that a conductive insert is positioned in said vacuum holes, said conductive insert being sufficiently conductive to maintain the continuity of an electric field applied to urge the toner to transfer to the receiving sheet and said conductive insert being formed of a material through which the vacuum can be maintained.

9. Apparatus according to claim 8 wherein said insert is made of a foam material.

10. Apparatus according to claim 9 wherein said foam material is a polyurethane foam having cell diameters approximately 0.5 mm.

11. The apparatus according to claim 10 wherein said drum has an exterior layer of polyurethane and said foam is a polyurethane foam having a conductivity similar to that of the polyurethane layer.

12. Apparatus according to claim 8 wherein said vacuum holes have two diameters the larger diameter being toward the surface of the drum and the insert is placed solely in the larger diameter portion of the hole.

13. Apparatus for transferring an electrostatically held toner image to a receiving sheet from an image-bearing member, which apparatus includes a transfer drum to which the receiving sheet is held by a vacuum applied through vacuum holes in said drum, said drum and image-bearing member being positioned to form a transfer nip and said drum and image-bearing member moving through said nip to gradually bring the entire transfer sheet into transfer relationship with a toner image carried by said image member, characterized in that said vacuum holes are partially covered by a material which is sufficiently conductive to maintain the continuity of conductivity of the surface of the drum and is sufficiently porous to permit the maintenance of the vacuum through the vacuum holes.

14. The apparatus according to claim 13 wherein said material is carried in a recess in the external layer of said drum and presents, with said layer, a substantially uniform exterior surface to the image-bearing member.

15. Apparatus according to claim 13 wherein said material is an open-celled foam which has been positioned in a recess associated with the external portion of each vacuum hole.

16. Apparatus according to claim 13 wherein said material is an open cell foam which has been grown in the vacuum hole.

17. Apparatus for forming multicolor toner images on a receiving sheet, said apparatus including means for forming a series of electrostatic images on an image-bearing member, means for toning said electrostatic images with toners of different colors, apparatus for transferring a plurality of said images to a receiving sheet in registry with each other image, to form a multicolor image on said receiving sheet, wherein said transferring apparatus includes:

a transfer drum having a conductive surface and having vacuum holes to said surface, means for applying a vacuum to said vacuum holes to hold a receiving sheet on the surface of the drum, means for creating an electric field urging a toner toward said drum, and means positioned in said vacuum holes, said means being sufficiently conductive to improve the continuity of said electrical field sufficiently porous to permit maintenance of a vacuum on the receiving sheet.

18. Apparatus according to claim 17 wherein said transfer apparatus has at least two sets of vacuum holes running parallel to its axis, one to hold the leading edge of each of two receiving sheets, and wherein said apparatus for forming multicolor images has a first mode of operation in which two receiving sheets are held on opposite halves of said transfer drum by said sets of vacuum holes and consecutive pairs of images are toned with different colors on said image bearing member, the color in any pair being the same, and a second mode in which the leading edge of a single receiving sheet is held by one set of vacuum holes and that receiving sheet overlaps the other set of holes and consecutive images are toned with different colors on said image bearing member.

* * * * *